US005954889A

United States Patent [19]

Wertheimer

[11] Patent Number: 5,954,889

[45] Date of Patent: Sep. 21, 1999

[54] METHOD FOR CLEANING JEWELRY BY DISPENSING A FOAMY SUBSTANCE ONTO THE JEWELRY FROM AN AEROSOL DISPENSER

[76] Inventor: Steven Wertheimer, 162 S. Harrison Ave., Congers, N.Y. 10920

[21] Appl. No.: 09/082,986

[22] Filed: May 21, 1998

[51] Int. Cl.[6] ..... B08B 1/00; B08B 7/04

[52] U.S. Cl. ..... 134/6; 134/7; 134/26; 134/42; 401/190; 15/160

[58] Field of Search ..... 134/6, 7, 26, 42; 15/160; 401/190

[56] References Cited

U.S. PATENT DOCUMENTS 3,116,856 1/1964 Prussin ..... 222/394
3,672,546 6/1972 Ruhle ..... 222/402.12
3,993,224 11/1976 Harrison ..... 222/145
5,306,439 4/1994 Lockhart ..... 252/174
5,307,964 5/1994 Toth ..... 222/402.13
5,578,562 11/1996 Lockhart ..... 510/446

*Primary Examiner*—Zeinab El-Arini
*Attorney, Agent, or Firm*—Stanley J. Yavner

[57] ABSTRACT

A method for cleaning jewelry includes dispensing a foamy substance onto an item of jewelry from an aerosol dispenser, using a scrubbing brush to scrub the jewelry item with the foamy substance thereon, in order to cause the foamy substance to become more foamy, thereby to enhance and complete the cleaning process. Thereafter, the item of jewelry is rinsed.

2 Claims, 3 Drawing Sheets

METHOD FOR CLEANING JEWELRY BY DISPENSING A FOAMY SUBSTANCE ONTO THE JEWELRY FROM AN AEROSOL DISPENSER

FIELD OF THE INVENTION

This invention relates primarily to aerosol dispensing apparatus for dispensing a foamy substance for cleaning jewelry, and more particularly for such apparatus for dispensing a foamy substance and including a straw-like output for the substance dispersed; as well as a method for use thereof, which involves the use of a scrubbing brush on the item being cleaned, which causes the foamy substance to foam even more.

BACKGROUND OF THE INVENTION

For a number of years, jewelry cleaning, such as the cleaning and brightening of diamonds, has been accomplished by dipping the diamond, or the diamond and its setting, in a detergent substance, such as ammonia, leaving the diamond therein for a period of time and then removing the cleaned diamond. This process, and the dish and ammonia apparatus used therefor, has proven to accomplish the cleaning objective with a moderate level of success. However, the drawbacks include the rather acrid aroma of the ammonia used, as well as the potential mess involved with the open dish usually used.

A couple of decades ago, it became apparent, particularly to shaving substance manufacturers, that the use of foam, rather than liquid or cream presented a less messy process and apparatus for accomplishing the objectives involved in the shaving process. An example of this is in the Ruhle patent, U.S. Pat. No. 3,672,546.

Still further, during the last few decades, the manufacturers of various substances, such as resins, medicaments and even cleaners or insecticides, have discovered and developed the use of a straw-like output for aerosol dispensing of these substances. Such development has been a recognition that the straw-like output would better direct the substances. Examples of these are represented in U.S. Pat. No. 3,993,224, a patent invented by Harrison; U.S. Pat. No. 3,116,856, an invention of Prussin and U.S. Pat. No. 5,307,964, inventor Toth.

Of course, the Harrison patent discloses a resin dispenser, kept from plugging up with resin material, and using a straw-like output for accomplishing that result. Prussin also uses a straw-like spout for dispensing medicaments in a pivotably directional manner. Toth uses the straw-like output concept for dispensing cleaners or insecticides for an aerosol container to desired particular locations, but which is not particularly suitable for delivering a directional foam output.

In all of these prior art devices, neither the jewelry cleaning objective, nor the use of a foamy substance dispensed from an aerosol container is addressed.

OBJECTS AND SUMMARY OF THE INVENTION

Accordingly, a primary object of the present invention is to provide an apparatus and process for cleaning jewelry, which makes use of an aerosol dispenser with a directional output, particularly for cleaning small items such as diamonds, or other jewelry.

A further and more particular object of the present invention is to provide a jewelry cleaning apparatus and method which is generally odorless, and yet accomplishes these objectives without undue mess.

These and other objects of the present invention are provided in an apparatus which features an aerosol dispenser for dispensing a foamy substance. The aerosol dispenser includes an output structure having a straw-like conductor element for conducting and directing the foamy substance output to the object being cleaned. Within the aerosol dispenser the following classes of compounds are included: sodium alkyl sulfates, sodium alcohol ether sulfates and fatty acid alkanolamides. Additionally, the aerosol dispenser includes a propellant, as is commonly used in such aerosol dispensers, and which is well known to those skilled in the aerosol dispenser art.

The process of cleaning includes the steps of dispensing the compound from the inside of the aerosol dispenser, by means of the propellant, propelling a foamy substance through the straw-like element, onto the object being cleaned, using a scrubbing brush to rub the foamy substance on the object being cleaned thereby to cause the foamy substance to be even more foamy. The object being cleaned by this process is an item of jewelry, such as a diamond or a diamond ring.

BRIEF DESCRIPTION OF THE DRAWINGS

Other objects, features and advantages of the present invention will become apparent by reference to the following more detailed description of the preferred, but nonetheless illustrative, embodiment of the apparatus and process for jewelry cleaning, with reference to the accompanying drawings, wherein.

DETAILED DESCRIPTION OF THE PREFERRED EMBODIMENTS OF THE APPARATUS AND PROCESS

Figure 1:
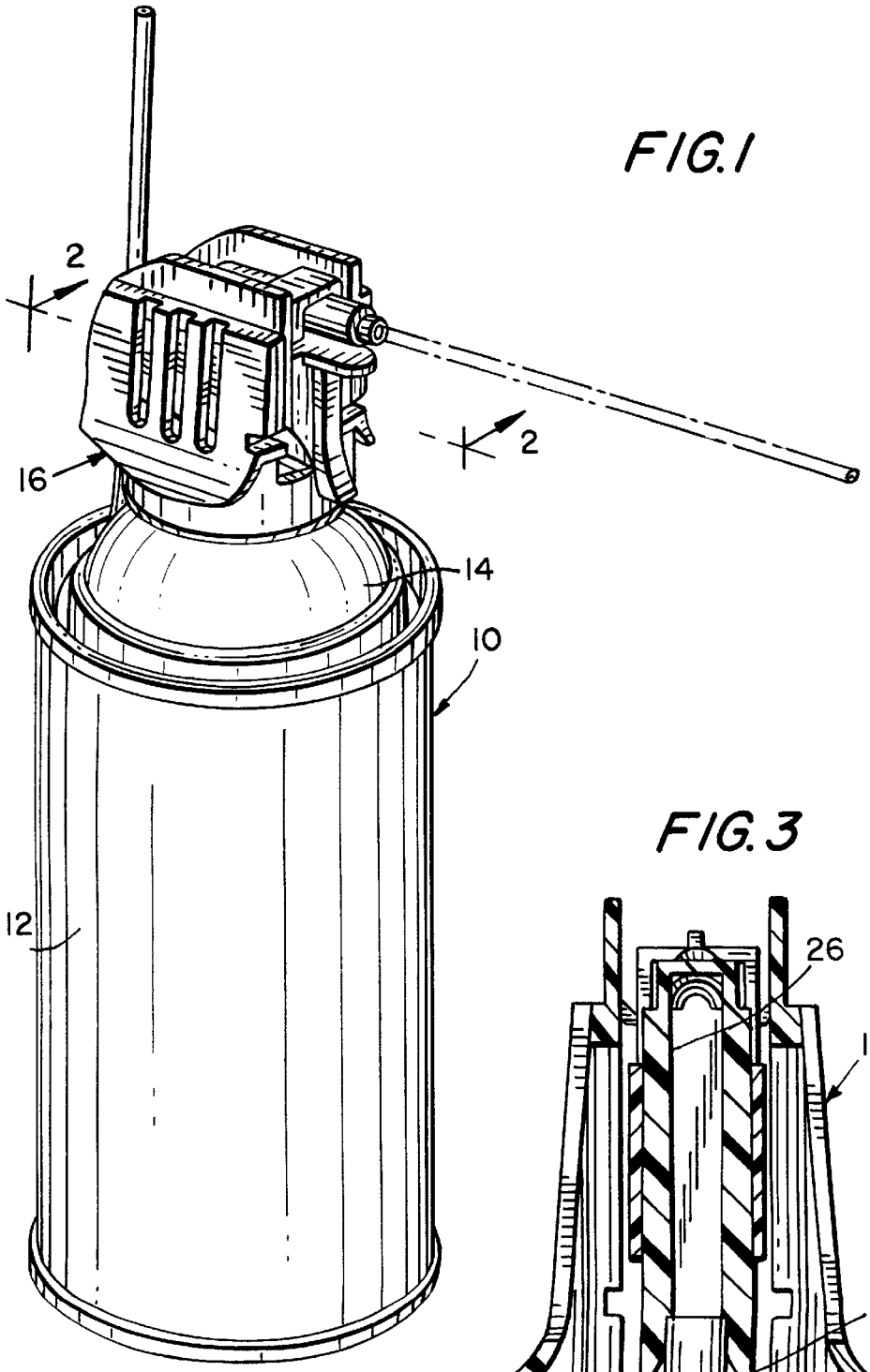
FIG. 1 is a front, top and left side isometric view of an aerosol dispenser, showing the straw-like directional output element in storage position, and in ghost lines showing such element as it is used in the present invention apparatus and process, for directing the foamy substance from the aerosol dispenser onto the object for cleaning.

Referring to FIG. 1, an aerosol dispenser, commonly available and well known to those skilled in the aerosol dispenser art, is generally designated 10. It includes an aerosol dispenser body 12, an aerosole dispenser neck 14, and an aerosol dispenser cap structure, generally designated 16.

Within the body 12 is placed a chemical composition, including the following classes of compounds: sodium alkyl sulfates, sodium alcohol ether sulfates and fatty acid alkanolamides (none of which are shown). Also within body 12 is an appropriate propellant for moving the chemical composition out through the cap structure 16 in the form of a foamy substance.

Figure 2:
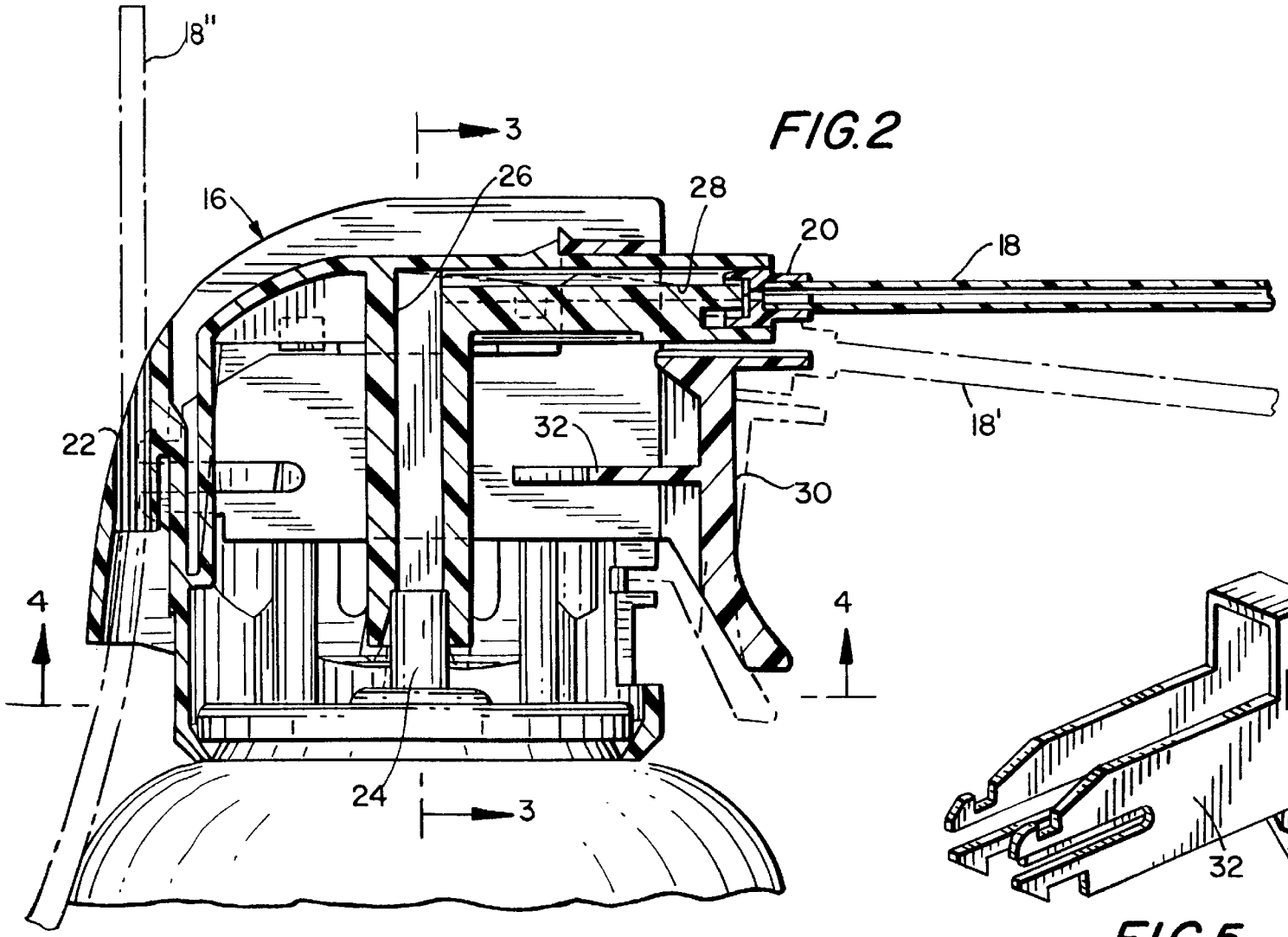
FIG. 2 is a left side, sectional view, taken along the line 2—2 of FIG. 1 and showing particularly the aerosol dispenser cap structure with the straw-like element in position for use and directional adjustment.

As is shown particularly in FIG. 2, a straw-like element 18 is connected into spout 20 for causing the foamy substance as an output from aerosol dispenser 10 in a directional manner. Ghost lines 18' represent the adjustability of straw-like element 18 in order to better direct the foamy substance to the object being cleaned. Ghost lines 18" represents the position of straw-like element 18 during storage or non-use of the apparatus. In this respect, straw-like element 18 is inserted to a cylindrical opening 22 defined by the back area of cap structure 16.

Figure 5:
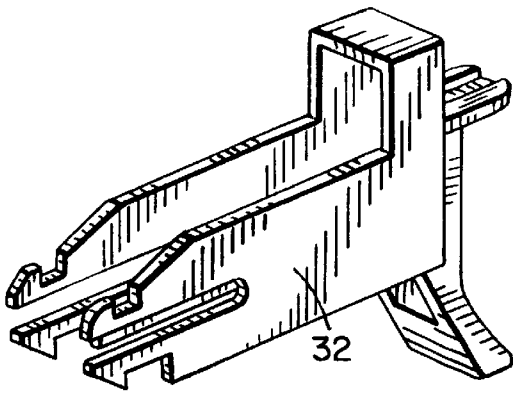
FIG. 5 is an isometric view of the trigger structure for the aerosol dispenser.

In order to better explain the flow of the foamy substance output, a nipple 24 is at the top of neck 14, and foamy substance flows through nipple 24 into passages 26 and 28, and then through spout 20 into straw-like element 18, when trigger 30 is pressed by the user. The pressing of trigger 30 advances trigger element 32 (FIG. 5) toward the back end of cap structure 16. This advancing action enables the output of foamy substance, by means of the propellant, through nipple 24, and then as described previously herein.

Figure 3:
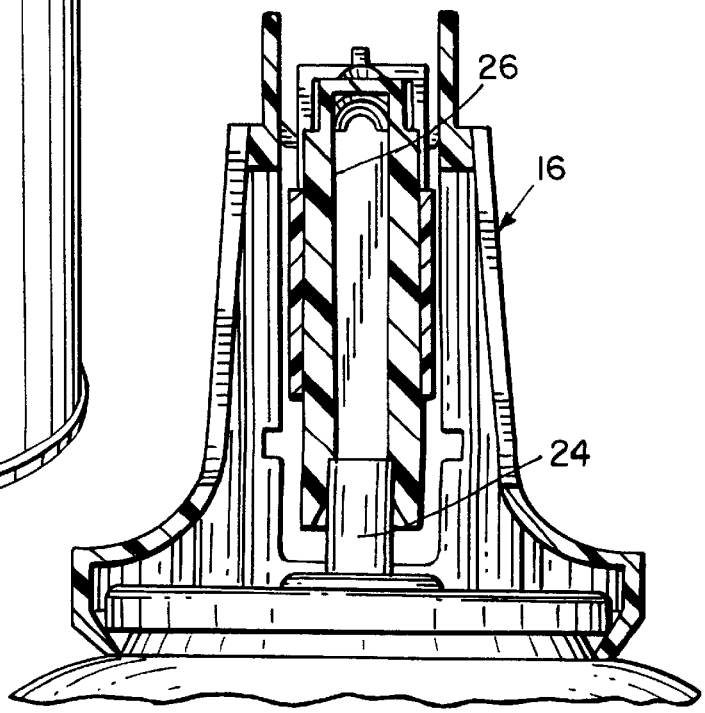
FIG. 3 is a rear, sectional view of the aerosol dispenser cap structure, taken along the line 3—3 of FIG. 2.
Figure 4:
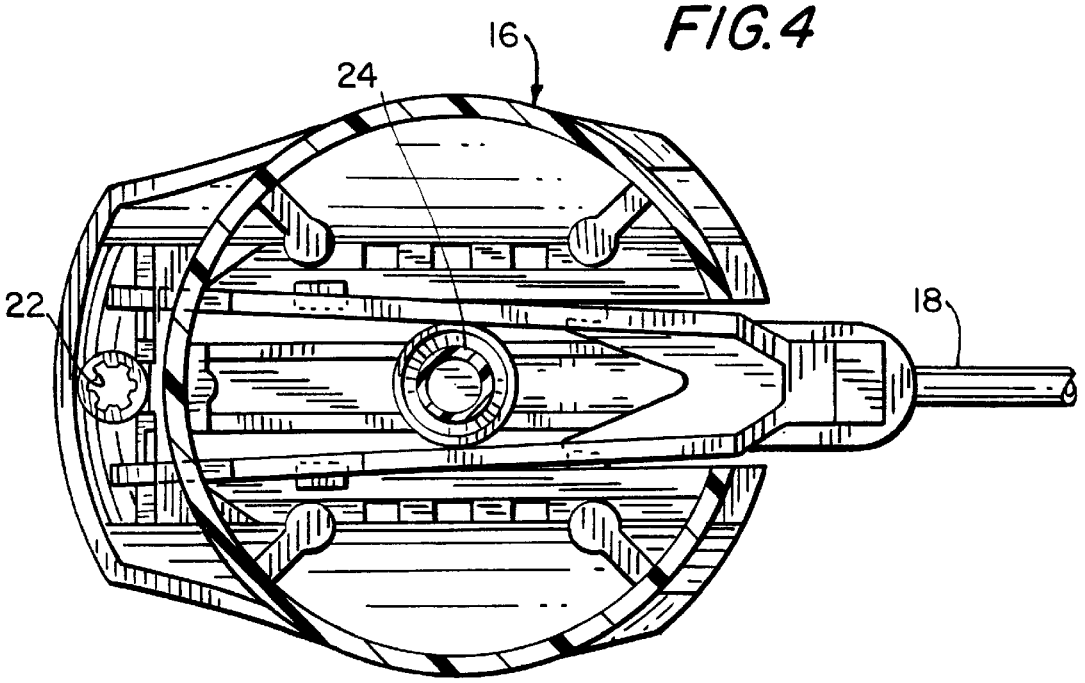
FIG. 4 is a bottom, sectional view, taken along the line 4—4 of FIG. 2, and showing particularly the underside of the cap structure.

The other drawings, FIGS. 3 and 4 illustrate various other features and aspects of cap structure 16.

Figure 6:
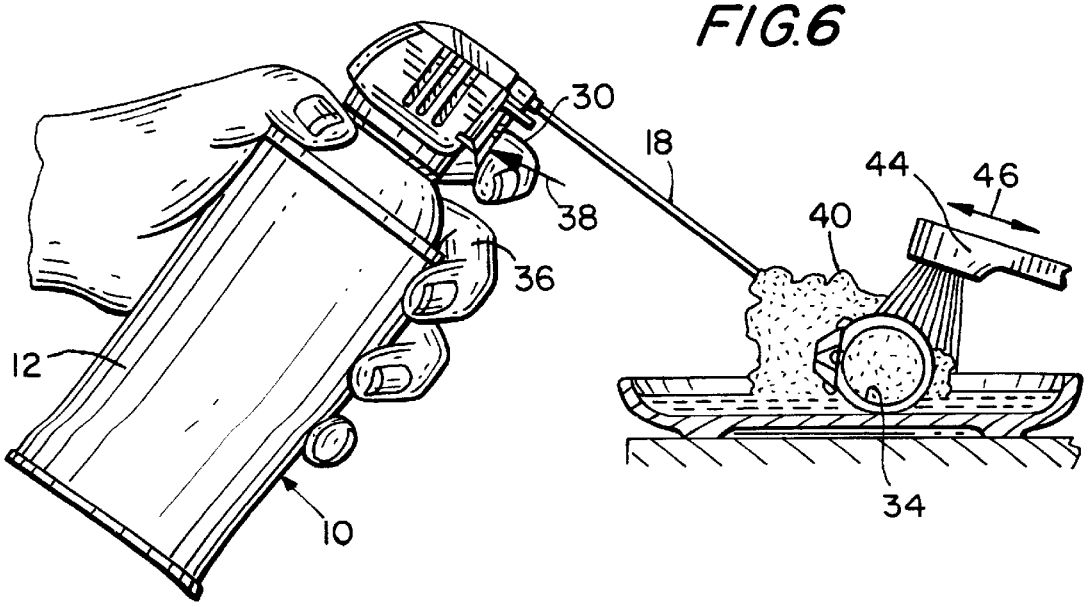
FIG. 6 illustrates the steps of the process of the present invention, using the aerosol dispenser, by pressing the trigger to cause an output of foamy substance through the straw-like element directionally onto a diamond ring placed in a saucer-like container, and the motion of the scrubbing brush on the diamond ring for causing the foamy substance to foam even more as it and the scrubbing brush accomplish the cleaning.

FIG. 6 shows the use of the apparatus in the process of cleaning a piece of jewelry, such as diamond ring 34. As may be seen from FIG. 6, trigger 30 is pressed by the user 36 in the direction represented by arrow 38 to cause a foamy substance 40 to be directed to ring 34, while it is in a saucer-like container 42. Immediately, the foamy substance in contact with ring 34 starts the cleaning process. The process is enhanced by use of scrubbing brush 44 moving back and forth in directions depicted by arrows 46. This scrubbing serves to enhance the foaming of foamy substance 40, and thereby completes the cleaning process.

In order to provide a fuller understanding of the apparatus and process according to the present invention, a series of use and process steps will now be described. User 40 removes straw 18 from its position represented by ghost lines 18" in cylindrical opening 22 and places straw 18 firmly in spout 20. Considering that the body 12 of aerosol dispenser 10 includes a propellant and a chemical composition to be propelled from body 12 to produce a foamy substance 40, user 36 presses trigger 30 in direction 38, thereby causing foamy substance 40 to be propelled through nipple 24 into passages 26, 28, to spout 20. Foamy substance 40 is then propelled through straw 18, which has been set in a proper direction 18 or 18' (FIG. 2) to impact upon ring 34. At this point of the process, ring 34 is in a saucer-like container 42 in order to avoid an unnecessary mess with respect to the cleaning process. Immediately upon impact of foamy substance 40 with ring 34, the user manipulates scrubbing brush 44, back and forth in directions 46, in order to cause foamy substance 40 to foam even more until the cleaning process has been completed.

While the apparatus and process, according to the present invention, has been described with particularity in the foregoing, the limits of the present invention are to be judged and provided only by the following claims.

What is claimed is:

1. A method for cleaning jewelry by use of a foamy substance dispensed from an aerosol dispenser comprising the steps of:

(a) dispensing said foamy-substance onto an item of jewelry;

(b) scrubbing said jewelry item with said foamy substance thereon, with a scrubbing brush, thereby to cause said foamy substance to become more foamy, in order to complete said cleaning; and (c) rinsing said item of jewelry.

2. The method according to claim 1 wherein said aerosol dispenser includes a nipple and a spout, with connecting passages therebetween and said dispensing is provided through said nipple, into said passages through said spout to a straw-like conductor element attached to said spout, from which said foamy substance is caused to be directionally applied to said item of jewelry.

* * * * *